United States Patent [19]

Fichter et al.

[11] 4,395,843

[45] Aug. 2, 1983

[54] TOY VEHICLE AND TRACK WITH A REDUCED AMOUNT OF RESISTANCE THEREBETWEEN

[75] Inventors: Barry Fichter; Chet Wolgamot, both of Cincinnati; Lawrence Schnipke, Urbana, all of Ohio

[73] Assignee: CPG Products Corp., Minneapolis, Minn.

[21] Appl. No.: 296,595

[22] Filed: Aug. 26, 1981

[51] Int. Cl.[3] ..... A63H 11/10

[52] U.S. Cl. ..... 46/202; 46/201

[58] Field of Search ..... 46/202, 201, 221, 1 K, 46/222, 206, 40; 273/86 R, 86 C

[56] References Cited

U.S. PATENT DOCUMENTS 4,250,656 2/1981 Barlow et al. ..... 46/40 X

*Primary Examiner*—Mickey Yu

*Attorney, Agent, or Firm*—Gene O. Enockson; L. MeRoy Lillehaugen; Stuart R. Peterson

[57] ABSTRACT

A free wheeling toy vehicle has the outer faces of its front wheels spaced a greater distance apart than the outer faces of its rear wheels. When the toy vehicle travels down an inclined track having upstanding sidewalls and one of the front wheels strikes one of the sidewalls due to travel of the vehicle at an acute angle toward that sidewall, the angle of travel of the vehicle is changed so that the vehicle moves away from the sidewall it has just struck. The overall resistance to movement down the inclined track is thereby reduced.

16 Claims, 18 Drawing Figures

10
12
12a
12b
14
16
20
22
24
26
30
32
34
35
36
37
40
46
52
54
56
58
60
64
68
68a
70
70a
72
72a
74
74a
86
88
90
92
100
102

20°

TOY VEHICLE AND TRACK WITH A REDUCED AMOUNT OF RESISTANCE THEREBETWEEN

BACKGROUND OF THE INVENTION

1. Field of the Invention

This invention relates generally to toy vehicles of the free wheeling type, and pertains more particularly to a toy vehicle of this character having a reduced amount of resistance between the vehicle and the channeled track along which it is intended to travel.

2. Description of the Prior Art

Free wheeling toy cars have been designed to travel over various types of surfaces. When the vehicles are used for racing, a considerable amount of competition and challenge usually develops between players. In an interparticipant game where free wheeling cars are permitted to gravitationally roll down an inclined plastic track having upwardly extending sidewalls, achieving the maxmimum speed and greatest distance that the car travels creates a keenly competitive atmosphere between the racing participants.

Accordingly, efforts in the past have been directed toward minimizing the amount of rolling friction as the car or vehicle gravitationally moves down the channeled track. Since wide wheels have been employed in order to resemble the tires of a racing car to reduce friction of the wheels with respect to the roadbed portion of the channeled track peripheral ribs have been employed. Also, the friction has been reduced by using tapered wheel surfaces instead of ribbed surfaces. In either instance, the amount of wheel contact with the simulated roadbed has been reduced with a concomitant reduction in rolling friction.

While it is commendable to reduce the amounts of rolling and journal friction, these are only two factors in the overall resistance picture. In order words, if one reduces the rolling friction, this is a step in the right direction (and the same holds true for reducing the bearing or journal friction). To reduce the friction or resistance between the wheels of a toy vehicle and the sidewalls of the channel track, the sidewalls have been angled so that they diverge upwardly, thereby providing only a point contact between the rim of the wheel and the wall, the point being where the motion is a minimum. Even though only a point contact can occur, there still remains a significant amount of friction resulting from the contact that does occur that retards the free movement of the car as it travels gravitationally down the track.

Accordingly, a general object of our invention is to reduce the overall amount of friction or resistance encountered by a free wheeling toy vehicle as it gravitationally travels or is launched down an inclined track. In this regard, an aim of the invention is to maintain a low amount of rolling resistance between the wheels of the vehicle and the roadbed of the track, as done in the past, but to further reduce the friction by minimizing the amount of rubbing contact that develops between the wheels of the vehicle and the sidewalls of the channeled track.

Another object of the invention is to achieve the foregoing objective without adversely detracting from the appearance of the toy vehicle. In this regard, it is intended that the toy vehicle retain its replicated appearance as to whatever actual vehicle it is intended to represent, yet incorporating therein the teachings of our invention. More specifically, it is within the purview of the invention to provide a toy car in which the reduced resistance is realized in a manner imperceptible to an ordinary observer.

A specific object of our invention is to correlate the lateral spacing of the front wheels of a toy vehicle with respect to the lateral spacing of its rear wheels, the correlation involving a greater spacing for the front wheels than the rear wheels so that less contact of the wheels with the sidewalls of a channeled track results as the car rolls down the track. It is within the contemplation of the invention to select a differential lateral wheel width between the front and rear wheels in accordance with the wheel base of the toy vehicle so that a maximum reduction of friction is experienced for that particular vehicle.

Yet another object of the invention is to provide a toy vehicle of the foregoing character which will cost no more to manufacture than toy vehicles of the free wheeling type that are already on the market.

Briefly, our invention envisages a toy vehicle of the free wheeling type in which the front wheels have a greater lateral spacing than the rear wheels. When such a vehicle is employed in combination with a channeled track having upstanding and outwardly diverging sidewalls, the greater spacing of the front wheels causes either of the front wheels, as the case may be, to contact one of the sidewalls when the vehicle assumes an acute angle with respect to that particular sidewall so that the front wheel strikes the sidewall with a glancing blow that is of only a moderate magnitude with the consequence that the rear wheel at that side of the vehicle then swings toward the sidewall that has been engaged by the front wheel with the result that the vehicle is then headed at an angle away from that particular sidewall. By employing a differential in lateral spacing that is correlated with the wheel base and also the width of the track, an overall combination of toy vehicle and track is realized wherein the toy vehicle travels throughout the length of the track with a less frequent contact of its wheels with the track's sidewalls. Not only is there a reduction in the number of contacts as the toy car traverses the length of track, but there is also a reduced amount of force with which the wheels bear against the sides of the track when contact does occur.

An optimum condition would result if the toy vehicle traveled down the channeled track without striking either sidewall during the movement throughout the length of the track. While this is an ideal condition, it is readily apparent that it is not achievable in practice. Nonetheless, by reducing the contact force and the average period of time for each contact, the ideal situation just alluded to can be more closely approached than heretofore.

BRIEF DESCRIPTION OF THE DRAWINGS

FIG. 12 is a greatly enlarged plan view depicting the chassis in the position shown in FIG. 11D, the greatly enlarged view permitting an angular relation to be better illustrated.

DESCRIPTION OF THE PREFERRED EMBODIMENT

Figures 1, 2, 3:
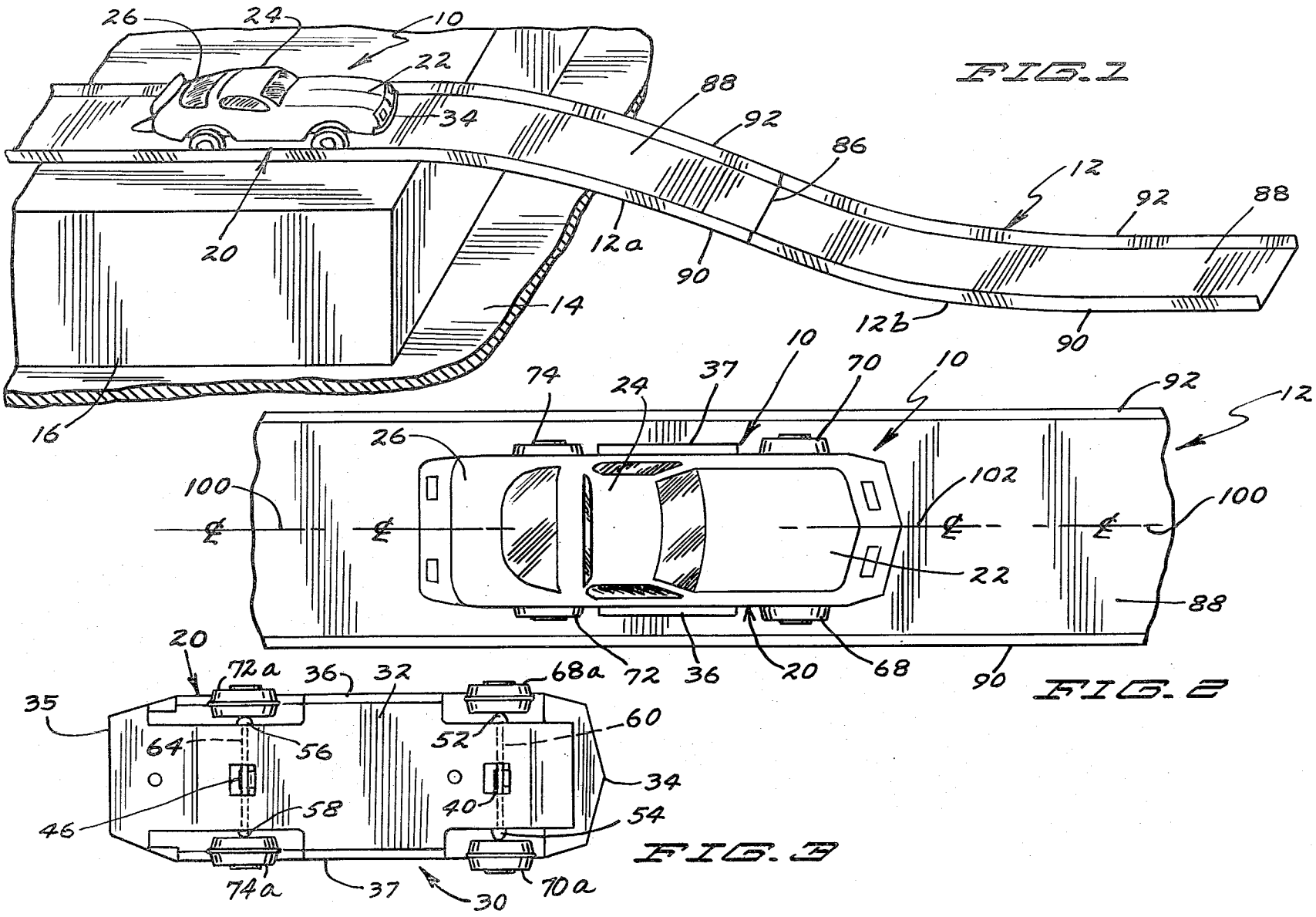
FIG. 1 is a perspective view of a toy vehicle constructed in accordance with our invention which is about to begin its descent down or travel along a channeled track.
FIG. 2 is an enlarged top plan view of the toy vehicle of FIG. 1 in its initially centered position on the track.
FIG. 3 is a bottom plan view of the car, the scale being the same as in FIG. 2.
Figure 4:
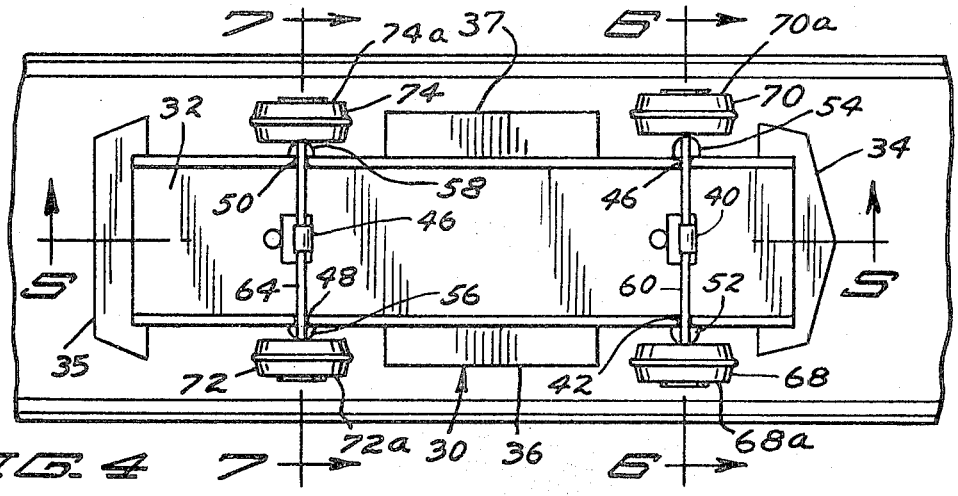
FIG. 4 is a top plan view corresponding to FIG. 2, but with the body of the vehicle removed so as to expose to view the chassis and the manner in which the wheels are mounted thereon.
Figure 5:
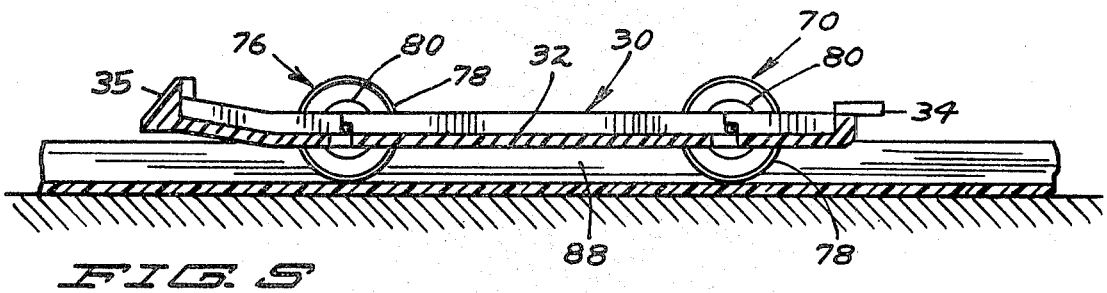
FIG. 5 is a longitudinal sectional view taken in the direction of line 5—5 of FIG. 4, the underlying roadbed of the track also appearing.
Figure 6:
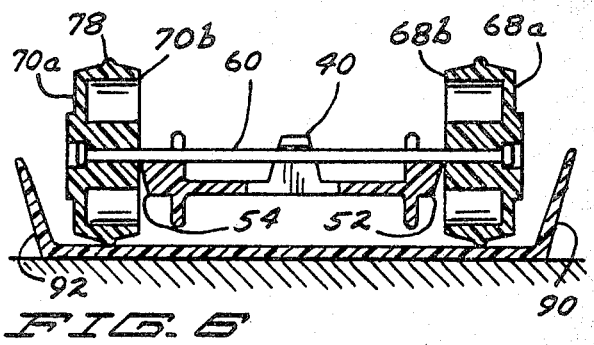
FIG. 6 is a transverse sectional view in the vertical plane of the vehicle's front axle for the purpose of more clearly showing the lugs or ears projecting from the sides of the chassis that determine the lateral spacing of the toy's front wheels, the view being taken in the direction of line 6—6 of FIG. 4.
Figure 7:
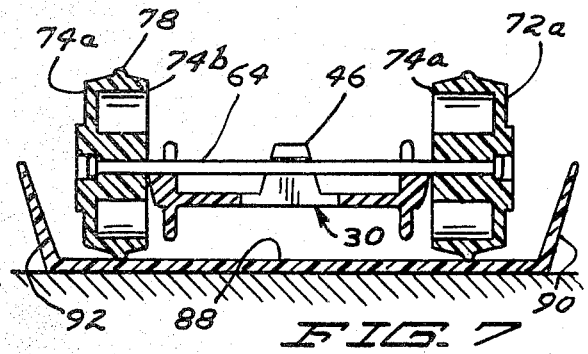
FIG. 7 is a sectional view similar to FIG. 6, the view being taken in the direction of line 7—7 of FIG. 4 and showing the lugs that determine the spacing of the rear wheels.

In order to provide an appreciation of our invention, reference should first be made to FIG. 1 in which a toy vehicle or car constructed in accordance with our invention has been denoted generally by the reference numeral 10. The toy vehicle or car 10 has been placed at the upper end of a channeled track 12 which will be described in greater detail hereinafter. While various types of supports can be used in order to provide a desired inclination to the track 12, a flat surface in the form of a table top 14 has been shown with a cubicle or box 16 placed thereon. As is believed obvious, the toy vehicle 10 is intended to roll gravitationally down the track 12. As the description progresses, it will be seen that the vehicle 10 is of the free wheeling type and is specially fabricated so as to reduce the overall friction or resistance between the vehicle 10 and the track 12.

Describing the vehicle 10 with greater particularity, it will be seen that it includes a body 20, typically of cast white metal that is heavy enough to impart a desired amount of mass to the vehicle 10. The body 20 is formed in the illustrated model with a hood 22, a driver compartment 24 and a trunk 26. It is important that the toy vehicle 10 traverse the track 12 with the hood 22 at the front.

Whereas the toy vehicle 10 is pictured with the body 20 thereon in FIGS. 1, 2 and 3, the details of the chassis, which has been indicated generally by the reference numeral 30, are better understood by resorting to certain of the other figures in which the body 20 does not appear. The chassis 30 comprises a web or pan-like frame 32, which can be of lightweight plastic such as ABS, inasmuch as the heavier metal body 20, such as zinc alloy, imparts the desired amount of mass to the vehicle 10. The frame 32 has a front bumper 34 molded integrally therewith and a rear bumper 35 also molded integrally therewith. Extending upwardly from the frame 32 is a front axle hook 40, and formed in the sides of the frame 32 are front axle slots 42 and 44. Similarly, there is an upstanding rear axle hook 46 and rear axle slots 48 and 50.

Further included in the chassis 30 are front lugs or ears 52, 54 and rear lugs or ears 56, 58. These lugs 52, 54, 56 and 58 project laterally from the sides of the frame 32, as best appreciated from FIGS. 6, 7, 9 and 10. It will soon become apparent that the lugs 52, 54, 56 and 58 play an important role in the practicing of our invention.

At this time reference will be made to a front axle indicated by the reference numeral 60 having a swaged head 62 at each end thereof. There is a rear axle 64 having swaged heads 66 formed thereon. It will be understood that the axles 60 and 64 are actually rather stiff spring wires. The central portion of the front axle 60, being resilient, is flexed into engagement with the front hook 40 to anchor this axle on the chassis 30, the end portions of the front axle 60 extending outwardly through the slots 42 and 44 in the frame 32. The rear axle 64 is centrally flexed so that it is held in place by the rear hook 46, the end portions of the axle 64 extending laterally through the slots 48 and 50.

Although all of the wheels for the toy vehicle 10 are identical in width (although in some models the rear wheels are larger than the front wheels), it will facilitate an understanding of the invention if separate reference numerals are assigned to each wheel. Therefore, the right front wheel has been given the reference numeral 68, the left front wheel the numeral 70, the right rear wheel the numeral 72 and the left rear wheel the numeral 74. Each wheel 68, 70, 72 and 74 has a flat cylindrical periphery labeled 76 having a centrally disposed circumferential rib 78 formed thereon. From FIGS. 6, 7, 9 and 10, it can be observed that there is a central hub 80 having a bore 82 extending therethrough, there being a counterbore 84 that provides a recess for the accommodation of the swaged heads 62 and 66.

While a certain amount of rolling friction is eliminated by simply having the wheels 68, 70, 72 and 74 of plastic, sugestively ABS or other lightweight plastic, an additional amount of rolling friction is eliminated by employing the peripheral ribs 78. The use of ribs, as earlier herein mentioned, is not new.

Reference has already been made to the lugs or ears 52, 54, 56 and 58. What has not yet been explained, though, is that the lateral distance from the tip or free end of the right lug 52 to the tip or free end of the left lug 54 is greater than the corresponding distance between the tips of the rear lugs 56 and 58. From FIGS. 6, 7, 9 and 10, as well as certain of other Figures, it is readily apparent that the various hubs 80 can rotatably engage or bear against the tips of these lugs 52, 54, 56 and 58. More specifically the hub 80 of the wheel 68 (see FIGS. 6 and 9) rotatably bears against lug 52 and the hub 80 of the wheel 70 bears against the lug 54 (also see FIGS. 6 and 9). The hub 80 of the wheel 72 (see FIGS. 7 and 10) similarly bears against the lug 56, whereas the hub 80 of the wheel 74 (FIGS. 7 and 10) engages the lug 58. Inasmuch as the axles 60 and 64 are somewhat longer (but equal in length) than need be in order to avoid undue engagement of the heads 62 and 66 with the wheels 68, 70 and 72, 74, respectively, the wheels 68, 70, 72 and 74 can shift to a limited extent along their respective axles, there being a sufficient amount of axle length so that this can occur.

What is important to recognize, however, is that the wheels 68, 70 cannot move inwardly more than that permitted by lugs 52, 54, and the wheels 72, 74 cannot move inwardly more than that allowed by the lugs 56, 58. Consequently, by virtue of the presence of the lugs 52 and 54, the tips of which are farther apart than the tips of the lugs 56 and 58, it follows that the spacing between the front wheels 68 and 70 is greater than the spacing between the rear wheels 72 and 74. As soon will become clear, it is really the differential spacing between the outer faces of the wheels 68, 70 with respect to the spacing between the outer faces of the wheels 72, 74 that is important. Therefore, the outer surface or face of the right front wheel has been labeled 68*a* and the outer face of the left front wheel 70, 70*a*. Similarly, the outer faces of the rear wheels 72 and 74 have been given the reference numerals 72*a* and 74*a*, respectively. For the sake of completeness the inner face of the wheels have been given the reference numerals 68*b*, 70*b*, 72*b* and 74*b*, the annular bearing surfaces of the various hubs 80 residing in planes of these faces 68*b*, 70*b*, 72*b* and 74*b*.

It will be understood, though, that the thickness of each wheel 68, 70, 72 and 74 is preferably the same, although the wider spacing of the front wheels 68, 70 with respect to the rear wheels 72, 74 could be realized by making the front wheels thicker than the rear wheels, the lugs 52, 54, 56 and 58 then all projecting the same distance from the centerline of the frame 32. In other words, the distance between the faces 68*a* and 68*b*, 70*a* and 70*b*, 72*a* and 72*b*, and 74*a* and 74*b* are equal when the same size wheel is used. Hence the lateral spacing of the front wheels 68, 70 as determined between the faces 68*a* and 70*a* or the faces 68*b* and 70*b* is greater than the spacing between the faces 72*a* and 74*a* or 72*b* and 74*b*. Hereinafter, some specific spacings between the faces 68*a*, 70*a* and between the faces 72*a*, 74*a* will be given.

From FIG. 2 it will be perceived that no part of the body 20 extends laterally beyond the wheel faces 68*a*, 70*a*, 72*a* or 74*a*. This is also evident from FIG. 3. Likewise, no part of the chassis 30 projects beyond the wheel faces 68*a*, 68*b*, 70*a* or 70*b*. Note especially that the simulated muffler systems 36 and 37 are both inwardly of the faces 68*a*, 70*a*, 72*a* and 74*a*.

Referring now in greater detail to the previously alluded-to track 12, it can be explained that it is customary to form the track 12 in various plastic sections or segments, usually of extruded polyethylene. Two segments 12*a* and 12*b* have been shown in FIG. 1. The separation line where the segments 12*a* and 12*b* abut each other has been identified by the reference numeral 86 in FIG. 1. The particular manner in which the segments 12*a* and 12*b* are releasably held together, as well as additional segments 12*c*, 12*d*, 12*e*, 12*f*, 12*g* (the segments 12*a*–12*g* being shown fragmentarily in FIGS. 11A–11G) and whatever others that might be employed to form the length of track 12 that is desired, is not important to a practicing of the invention.

The track segments 12*a*–12*g* in FIGS. 11A–11G constitute various segments of the track 12 that can be used in portraying a typical path that the toy vehicle 10 might follow during its downward travel along the track 12. The path that has been selected, and what happens as the toy vehicle 10 proceeds along such path, will soon be described.

The track 12, for the sake of facile description, includes a roadbed 88 that is flat. At each side of the roadbed 88 are integral sidewalls 90 and 92, the sidewalls 90 and 92 diverging upwardly from the roadbed 88 at an angle with respect to the vertical, more precisely an angle of 20° which has been labeled in FIG. 9.

It will also help in presenting an operational description to indicate the centerline of the track 12 by the reference numeral 100 and the centerline of the vehicle 10 by the reference numeral 102. Obviously, the centerline 102 of the vehicle 10 shifts from side to side of the centerline 100, and angularly throughout the travel of the vehicle 10 with respect to the centerline 100. Reference will soon be made to the variation in the angularity between the centerline 102 and the centerline 100, it being desirable to maintain the angle relatively small as the vehicle 10 approaches either sidewall 90, 92. Our invention enables this to be accomplished.

Basically, it must be borne in mind that the lateral spacing of the front wheels 68, 70, when utilizing the teachings of our invention, should be greater than the lateral spacing of the rear wheels 72, 74. More specifically, the spacing between the outer faces 68*a*, 70*a*, should be greater than the spacing between the outer faces 72*a*, 74*a*. Whereas the thickness or width of the wheels 68, 70, 72 and 74 is preferably the same, it follows that when the spacing between the faces 68*a* and 70*a* is greater than the spacing between the faces 72*a* and 74*a*, then the spacing between the faces 68*b* and 70*b* will be greater than the spacing between the faces 72*b* and 74*b*. With the lateral spacing of the front wheels 68 and 70 wider than the spacing between the rear wheels 72 and 74, it turns out that when the toy vehicle 10 having such a wheel spacing is travelling along a track of U-shaped or channeled cross section, as is the track 12, then the vehicle 10 will glance off the sidewalls 90 and 92 rather than hug these walls 90 and 92, the result being that the car 10 travels a greater distance along the track 12 than if the spacing between the front wheels 68, 70 and the spacing between rear wheels 72, 74 were equal or if the front wheels 68, 70 were more closely spaced than the rear wheels 72, 74. However, if the rear wheels 72, 74 are too closely spaced, then the toy vehicle 10 will continually bounce from one wall 90 to the other wall 92 and will rapidly lose its kinetic energy. Hence, there is an optimum greater spacing of the front wheels 68, 70 with respect to the spacing of the rear wheels 72, 74. In any event, the spacing of the front wheels 68, 70, according to our invention, must be greater (and not equal to or less) than that of the rear wheels 72, 74.

Generally speaking, it can be stated that where the wheelbase L (FIG. 12) for a toy vehicle, such as that indicated by the reference numeral 10, ranges from 1.5 to 2.4 inches, then the front spacing S (also FIG. 12) between the faces 68*a* and 70*a* should range from 1.155 to 1.215 inches and the spacing between the rear faces 72*a* and 74*a* should range from 1.128 to 1.212 inches. Stated somewhat differently, the optimum differential spacing between the front wheels 68, 70 and the rear wheels 72, 74 should be from 0.020 to 0.045 inch more on the front wheels with the preferred differential spacing being 0.030.

More specifically, for a wheelbase L of 1.9 inches then the best results occur, as far as achieving the greatest travel distance along the track 12, when the front wheel spacing is 1.186 inches and the rear wheel spacing is 0.030 inch less, that is 1.156 inches. If the wheelbase L is reduced, then the toy vehicle 10 will travel a lesser distance. Thus, for the same differential (0.020 to 0.045 inch) between the front wheel spacing and the rear wheel spacing, the distance traveled is less for a 1.7 inch wheelbase, and still less for a 1.5 inch wheelbase.

Another factor of importance in comparing tests is the width of the track 12, more specifically, the width W (FIG. 12) of the roadbed 88. The results listed above were realized with a roadbed having a width W of 1.28 inches. It will be understood that W can vary; it is just that for comparing results with changes in either L or S, W should remain constant.

It is also desirable to examine FIG. 12 as to the angularity between the centerlines 100 and 102. It will be observed that for the illustrated situation, the angle $\theta$ is equal to 0.45°. This gives the best distance for a wheel base L of 1.9 inches and a roadbed width W equal to 1.28 inches. With the front wheel spacing S reduced from 1.186 inches to 1.155 inches, then $\theta$ became 0.3° and where the front wheel spacing S is increased to 1.212 inches, then $\theta$ becomes 0.68°. In a way, it is somewhat easier to express the preferred relationships set forth above on the basis of maintaining the angle $\theta$ within a range of 0.3° and 0.68° with the preferred value being 0.45°.

Figure 8:
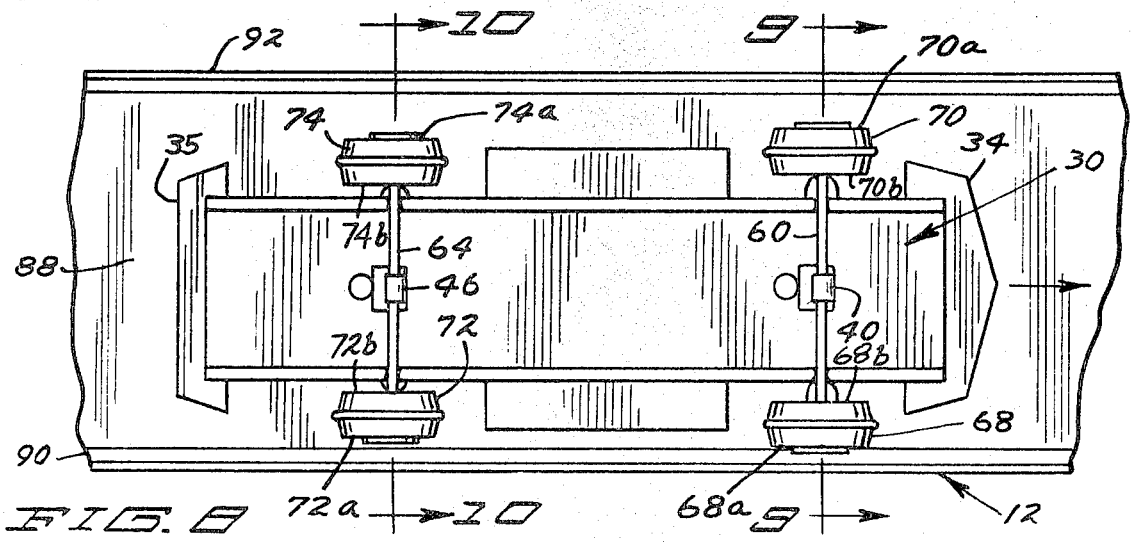
FIG. 8 is a top plan view resembling FIG. 4 but with the car to one side of the track and with its right front wheel against the track's right sidewall, the centerline of the vehicle being parallel to the centerline of the track.
Figures 9, 10, 11A, 11B, 11C, 11D, 11E, 11F, 11G:
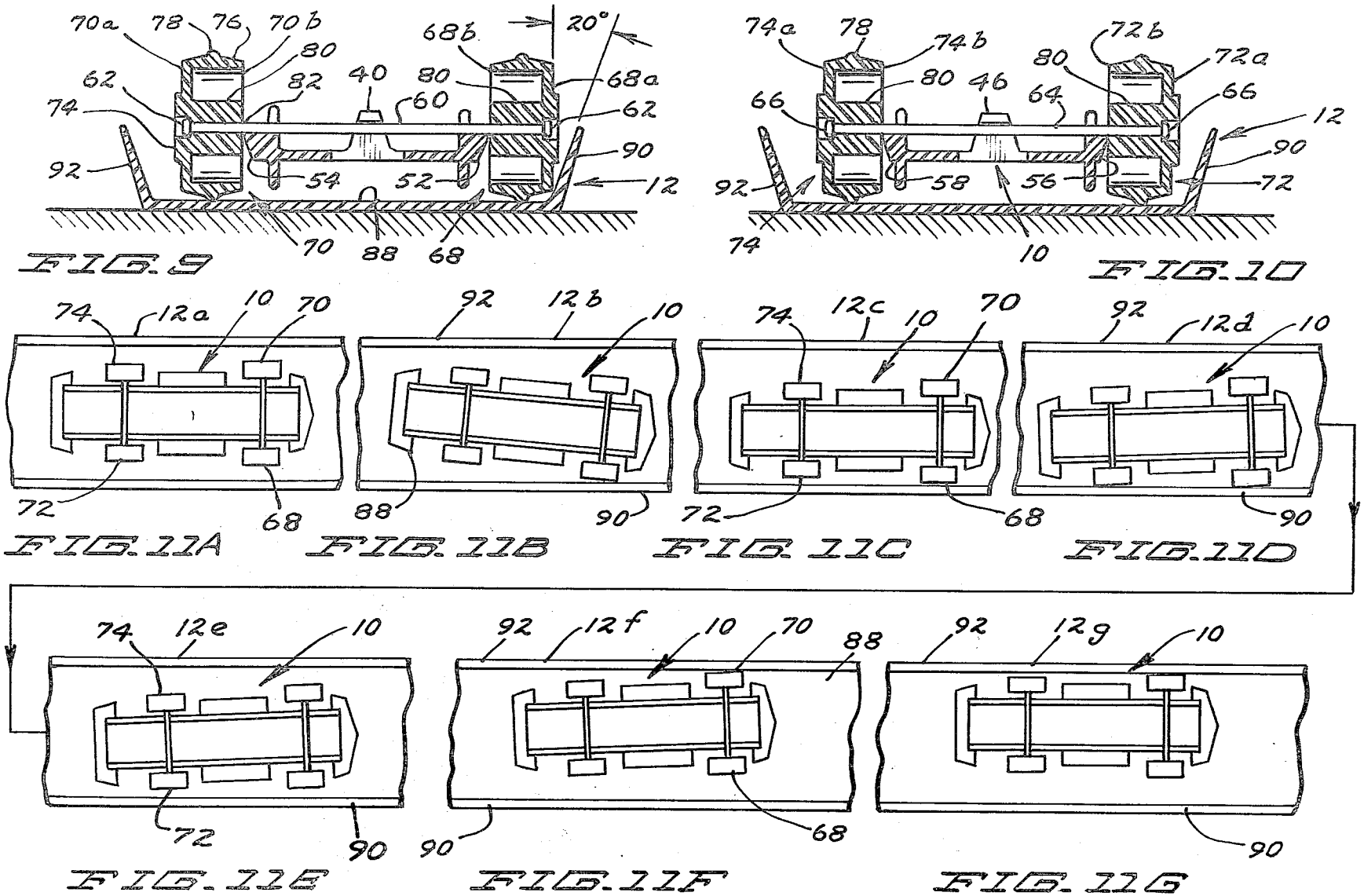
FIG. 9 is a sectional view much like that of FIG. 6 and on the same scale, but the view in this instance being taken in the direction of line 9—9 of FIG. 8.
FIG. 10 is a view similar to FIG. 7 and on the same scale, but the view being taken in the direction of line 10—10 of FIG. 8.
FIGS. 11A through 11G constitute a series of diagrammatic plan views of arbitrarily spaced track segments, each with my toy vehicle superimposed thereon so as to portray a typical path that a toy vehicle fabricated in accordance with my invention might follow as it moves downwardly along a substantial length of track.
Figure 2B:
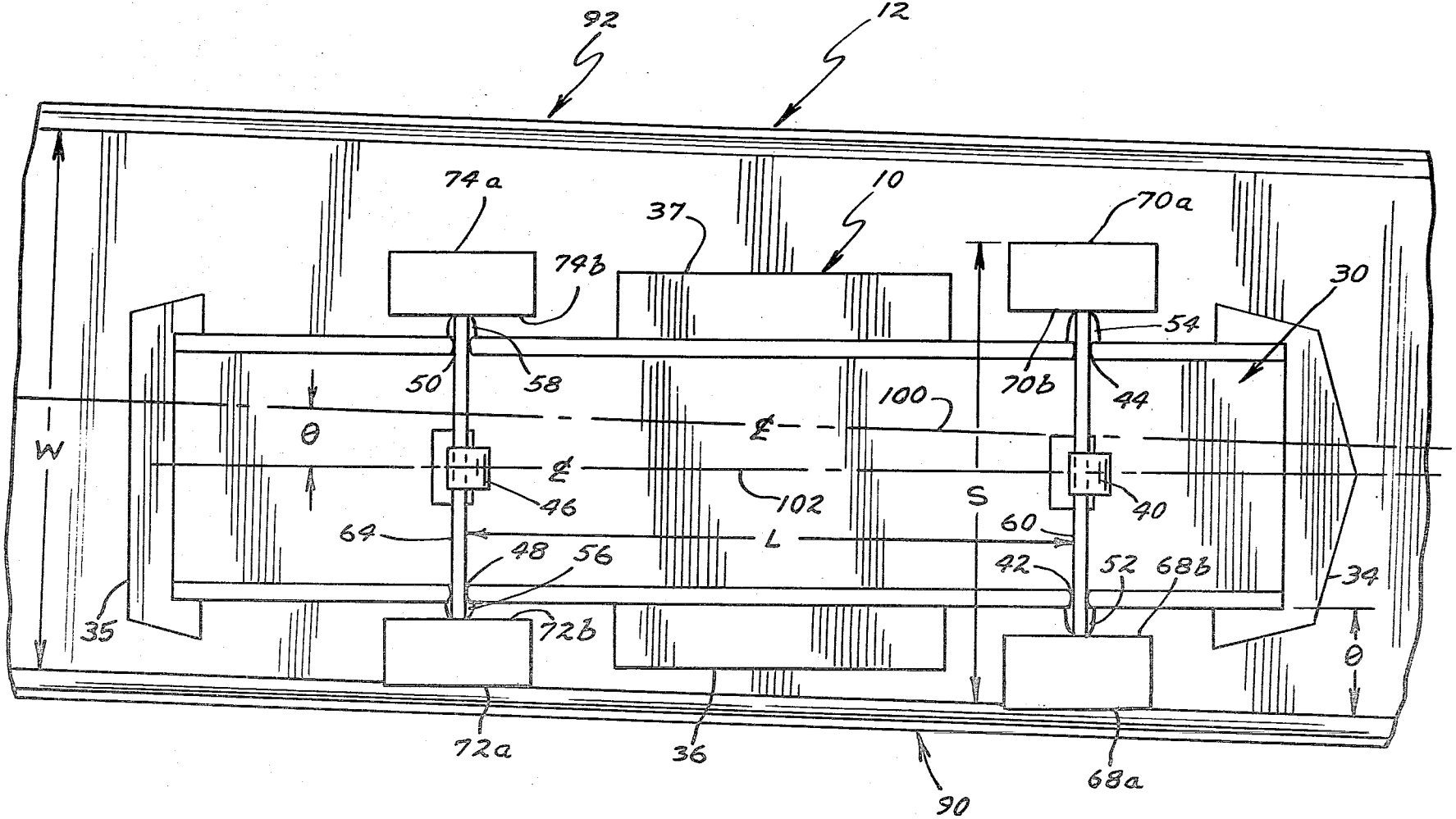

Recapitulating, it will be seen that the toy vehicle 10 when permitted to roll down the inclined track 12 will, for example, traverse a path indicated by the sequential views identified as FIGS. 11A–11G. In FIG. 11B the vehicle 10 is striking the sidewall 90 at an angle that produces a glancing blow as far as the right front wheel 68 is concerned. The shorter time interval that the wheel 68 remains in an engagement or contact with the sidewall 90, the better. In FIG. 11C, the vehicle 10 has changed position so that the centerline thereof is parallel to the centerline of the track segment 12*c*. This is the same condition that appears in FIG. 8. It will be helpful, it is believed, to note FIG. 9 at this point, for in the FIG. 9 it will be observed that the right front wheel 68 is in engagement with the sidewall 90, whereas in FIG. 10 it will be perceived that the right rear wheel 72 is spaced from this sidewall 90.

As can be noted from FIG. 11D, though, the right rear wheel 72 has swung against the sidewall 90 and the right front wheel 68 is still in engagement with the sidewall 90. FIG. 11D corresponds to FIG. 12, it will be perceived. What should be recognized, however, is that the centerline 102 of the vehicle 10 forms the angle $\theta$ with the center line 100 of the track 12, more specifically, the segment 12*d* in FIG. 11D. It should also be recognized that the centerline 102 of the vehicle 10 is angled at this stage of the vehicle's descent down the track 12 away from the sidewall 90. In other words, the vehicle 10, as viewed in FIG. 11D (and FIG. 12) is beginning to head away from the sidewall 90 toward the sidewall 92.

FIG. 11E is intended to show the further progress of the vehicle 10 as it continues its angled movement toward the opposite sidewall 92. In the next view, this being FIG. 11F, the left front wheel 70 engages the sidewall 92 with the consequence that when the stage depicted in FIG. 11G is reached, then the centerline 102 of the vehicle 10 again becomes parallel to the centerline 100 of the track 12, more specifically, the segment 12*g* appearing in FIG. 11G.

What should be distinctly understood is that either front wheel 68 or 70, as the case may be, strikes repeatedly the sidewall 90 or 92 during the downward travel of the vehicle 10 along the track 12 but that as soon as contact is made, there is a lateral swinging of the vehicle 10 so that its centerline 102 is changed from a direction toward the particular side wall 90 to a direction away from that wall 90 (or 92). In other words, the sidewall 90 (or 92) that has just been struck a glancing blow causes the centerline 102 of the car 10 to be changed so that it assumes an angle away from that particular sidewall.

Perhaps the action that transpires can be highlighted better by assuming for the moment that the lateral spacing of the front wheels 68 and 70 is less (rather than greater, which is the case when utilizing the teachings of our invention) than that of the rear wheels 72 and 74. Then, the centerline 102 of the vehicle 10 would continue to be in the direction of the particular sidewall 90 or 92 that has been struck, for the rear wheel 72 or 74 would already be "riding" against that particular sidewall. The longer that either front wheel 68 or 70 is in contact with either sidewall 90 or 92, the more resistance to free movement of the vehicle 10 results. Where both a front wheel 68 or 70 and a rear wheel 72 or 74 remains in contact with a particular sidewall 90 or 92, then the resistance to downward travel is even greater.

If the wheel spacing at the front and back is equal, then the hugging action is still present, the two wheels 68 and 72 (or 70 and 74) then hugging the sidewall 90 (or the wheels 70 and 74 hugging the sidewall 92).

From the foregoing, it should be obvious that if the front wheel 68 or 70 is in engagement with either sidewall 90 or 92 during the entire travel, there will be more friction developed than if the front wheels 68 or 70 are less frequently in engagement with either sidewall 90 and 92. The worst possible situation would be to have, say, the front wheel 68 and the rear wheel 72 both in engagement with the sidewall 90 during the entire length of the track 12, or vice versa, have the wheels 70 and 74 in engagement with the sidewall 92 during the full descent of the vehicle 10 down the track 12.

By having the vehicle 10 move from sidewall 90 to sidewall 92 and back again, continuing to do this a number of times during the entire travel down the length of the track 12, the result is that the vehicle 10 is not in engagement with either sidewall 90 or 92 for any significant length of time. Even when there is an engagement or contact, it is only for a short duration of time. Hence, the resistance to downward movement of the vehicle 10 along the track 12 is substantially reduced by having a reduced number of contacts between the wheels 68, 70, 72 and 74 with the sidewalls 90 and 92, and when there is contact or engagement, having that contact or engagement minimized on a time basis so that the total amount of friction, actually an integration of small increments of friction, is substantially reduced by the expedient of having the front wheel spacing imperceptibly greater than the rear wheel spacing. Stated somewhat differently, the contacts are for shorter intervals, and with less side force when contact is made.

We claim:

1. In combination with a track having a roadbed and upstanding sidewalls, a toy vehicle comprising a relatively rigid chassis, a pair of front wheels having oppositely directed outer faces and inwardly directed inner faces, and a pair of rear wheels having oppositely directed outer faces and inwardly directed inner faces, the outer faces of said front wheels and the outer faces of said rear wheels being spaced laterally beyond the sides of said chassis and the outer faces of said front wheels being nearer said sidewalls than the outer faces of said rear wheels when said chassis is placed centrally on said roadbed, first lug means projecting laterally from each side of said chassis for engaging the inner faces of said front wheels radially adjacent their axis of rotation to space the outer faces of said front wheels, and second lug means projecting laterally from each side of said chassis for engaging the inner faces of said rear wheels radially adjacent their axis of rotation to space the outer faces of said rear wheels a lesser amount than the spacing of the outer faces of said front wheels.

2. A toy vehicle in accordance with claim 1 in which said lateral spacing of said front wheels is from 0.020 to 0.045 inch greater than the lateral spacing of said rear wheels.

3. A toy vehicle in accordance with claim 2 in which said lateral spacing of said front wheels is approximately 0.030 inch greater than the lateral spacing of said rear wheels.

4. A toy vehicle in accordance with claim 3 in which the wheelbase is from 1.5 to 2.4 inches.

5. A toy vehicle in accordance with claim 4 in which said track has a roadbed extending between said sidewalls having a width on the order of 1.28 inches.

6. A toy vehicle in accordance with claim 5 in which the sidewalls of said track diverge upwardly from said roadbed at angles of 20°.

7. A toy vehicle in accordance with claim 1 in which the lateral spacing between the outer faces of said front wheels is from 1.155 to 1.215 inches and the spacing between the outer faces of said rear wheels is between 1.110 and 1.150 inches.

8. A toy vehicle in accordance with claim 7 in which the lateral spacing between the outer faces of said front wheels within said range of from 1.155 to 1.215 inches is from 0.020 to 0.045 inch greater than the lateral spacing between the outer faces of said rear wheels within the range of from 1.110 and 1.150 inches for the rear wheels.

9. A toy vehicle in accordance with claim 8 in which the differential is 0.030 inch.

10. A toy vehicle comprising a chassis, a pair of front wheels mounted for rotation about a first axis provided by said chassis, said front wheels having outer faces spaced laterally outward from the sides of said chassis, and a pair of rear wheels mounted for rotation about a second axis provided by said chassis, said rear wheels having outer faces also spaced laterally outward from the sides of said chassis, the lateral spacing between the outer faces of said front wheels being greater than the lateral spacing between the outer faces of said rear wheels, front and rear parallel axles providing said first and second axes, said axles having end portions projecting beyond said opposite sides of said chassis, said front wheels being journaled for rotation on the projecting end portions of said front axle and said rear wheels being journaled for rotation on the projecting end portions of said rear axle, laterally projecting lug means on said chassis adjacent said front axle for engaging the inner faces of said front wheels radially adjacent said front axle for limiting inward movement of said front wheels toward each other, and laterally projecting lug means on said chassis adjacent said rear axle for engaging the inner faces of said rear wheels radially adjacent said rear axle for limiting inward movement of said rear wheels toward each other, said limiting means for said front and rear wheels determining said greater lateral spacing for said front wheels.

11. A toy vehicle in accordance with claim 10 in which said limiting means adjacent said front axle includes a pair of tapered lugs projecting in opposite lateral directions from the sides of said chassis, the smaller, outer ends of said tapered lugs engaging the inner faces of said front wheels radially adjacent said front axle and in which said limiting means adjacent said rear axle includes a pair of tapered lugs also projecting in opposite lateral directions from the sides of said chassis, the smaller, outer ends of said last-mentioned pair of lugs engaging the inner faces of said rear wheels radially adjacent said rear axle.

12. A toy vehicle in accordance with claim 11 in which each wheel has the same thickness and in which the distance between the smaller ends of the lugs for said front wheels determines said lateral spacing for said front wheels and the distance between the smaller ends of said lugs for said rear wheels determines said lateral spacing for said rear wheels, the distance between the ends of the front lugs being greater than the distance between the ends of the rear lugs.

13. A toy vehicle in accordance with claim 12 in which said axles each constitute a spring wire, said spring wires extending across the upper side of said chassis, forward retention means on said chassis for releasably holding a central portion of said front wire, rear retention means on said chassis for releasably holding a central portion of said rear wire, said lugs projecting from said chassis at an elevation immediately beneath said wires and closely adjacent thereto.

14. A toy vehicle in accordance with claim 11 in which the ends of said axles each have an enlarged head for retaining said wheels on said axles, said heads on said front axle being spaced apart a sufficient distance so that each front wheel can shift laterally on its said end portion between the smaller end of the lug nearest thereto and the head nearest thereto, said heads on said rear axle being spaced apart a sufficient distance so that each rear wheel can shift laterally on its said end portion between the smaller end of the lug nearest thereto and the head nearest thereto.

15. In combination with a track including a roadbed and upstanding sidewalls equally spaced from the centerline of said roadbed, a toy vehicle constrained by said sidewalls for travel along said roadbed comprising a rigid chassis having a straight longitudinal centerline capable of following the centerline of said roadbed or angling to either side of said roadbed centerline as the chassis moves down said roadbed, first and second front wheels, said first front wheel being adjacent one side of said chassis and said second front wheel being adjacent the other side of said chassis, said first and second front wheels extending laterally beyond the sides of said chassis, first and second rear wheels, said first rear wheel being adjacent said one side of said chassis and said second rear wheel being adjacent said other side of said chassis, said first and second rear wheels extending laterally beyond the sides of said chassis, and respective laterally projecting lug means rotatably locating said first front wheel a greater distance from the centerline of said chassis than the distance said first rear wheel is rotatably located from the centerline of said chassis, said respective lug means engaging said first front wheel and said first rear wheel closely adjacent their respective axes of rotation, whereby when the centerline of said chassis is parallel to the centerline of said roadbed, the said first front wheel is closer to one of the sidewalls of said track than is said first rear wheel with respect to said one sidewall.

16. The combination of claim 15 including second respective laterally projecting lug means rotatably locating said second front wheel a greater distance from the centerline of said chassis than the distance said rear wheel is rotatably located from the centerline of said chassis, said second respective lug means engaging said second front wheel and said second rear wheel closely adjacent their respective axes of rotation so that when the centerline of said chassis is parallel to the center line of said roadbed the said second front wheel is closer to the other sidewall of said track than is the second rear wheel.

* * * * *

UNITED STATES PATENT AND TRADEMARK OFFICE

CERTIFICATE OF CORRECTION

PATENT NO. : 4,395,843

DATED : August 2, 1983

INVENTOR(S) : Barry Fichter, Chet Wolgamot, Lawrence Schnipke

It is certified that error appears in the above-identified patent and that said Letters Patent are hereby corrected as shown below:

Under Section [56], References Cited, please add the following references which were omitted:

--- 3,597,876 8/1971 Haji ..... 46/202 ---
--- 4,217,724 8/1980 Schoenfield et al ..... 46/202 X ---
--- 3,653,149 4/1972 Prodger et al ..... 46/201 ---
--- 2,917,864 12/1959 Payne ..... 46/202 X ---
--- 3,510,981 5/1970 La Branche et al ..... 46/202 ---.

Col. 1, line 37; "order" should be --- other ---,

Col. 5, line 8; insert --- the --- before "lugs 52, ---,

Signed and Sealed this

Tenth Day of July 1984

[SEAL]

Attest:

GERALD J. MOSSINGHOFF

Attesting Officer

Commissioner of Patents and Trademarks